US011565901B2

(12) United States Patent
Aikawa et al.

(10) Patent No.: US 11,565,901 B2
(45) Date of Patent: Jan. 31, 2023

(54) IMAGE FORMING SYSTEM

(71) Applicants: Noritoshi Aikawa, Yamanashi-ken (JP); Shogo Iwai, Yamanashi-ken (JP)

(72) Inventors: Noritoshi Aikawa, Yamanashi-ken (JP); Shogo Iwai, Yamanashi-ken (JP)

(73) Assignee: CANON FINETECH NISCA INC., Misato (JP)

( * ) Notice: Subject to any disclaimer, the term of this patent is extended or adjusted under 35 U.S.C. 154(b) by 240 days.

(21) Appl. No.: 17/129,036

(22) Filed: Dec. 21, 2020

(65) Prior Publication Data

US 2021/0198068 A1 Jul. 1, 2021

(30) Foreign Application Priority Data

Dec. 27, 2019 (JP) ..... JP2019-239875
Dec. 27, 2019 (JP) ..... JP2019-239876
Jun. 8, 2020 (JP) ..... JP2020-099629

(51) Int. Cl.

| | |
|---|---|
| ***B65H 5/36*** | (2006.01) |
| ***G03G 15/00*** | (2006.01) |
| ***B65H 7/12*** | (2006.01) |
| ***B65H 5/06*** | (2006.01) |
| ***B65H 3/14*** | (2006.01) |

(52) U.S. Cl.

CPC ..... *B65H 5/36* (2013.01); *B65H 3/14* (2013.01); *B65H 5/062* (2013.01); *B65H 7/125* (2013.01); *G03G 15/6511* (2013.01)

(58) Field of Classification Search

CPC ..... B65H 2601/111

See application file for complete search history.

(56) References Cited

U.S. PATENT DOCUMENTS 5,163,673 A * 11/1992 Heppenstiel ..... B65H 7/125 271/262
2008/0157463 A1* 7/2008 Kanazawa ..... B65H 3/44 271/225
2010/0189449 A1* 7/2010 Goto ..... G03G 21/1638 399/21
2015/0217956 A1* 8/2015 Kaneko ..... G03G 15/70 271/265.04

FOREIGN PATENT DOCUMENTS

JP 2007-279168 A 10/2007

* cited by examiner

*Primary Examiner* — Jennifer Bahls
(74) *Attorney, Agent, or Firm* — Manabu Kanesaka

(57) ABSTRACT

In order to miniaturize an image forming system, the present invention provides an image forming system which is provided with a sheet feed apparatus including a transport roller pair capable of transporting a sheet in a sheet transport direction S, and an image forming apparatus including an image forming section capable of forming an image on the sheet acquired from the sheet feed apparatus, including a switch member disposed on the downstream side of the transport roller pair in the sheet transport direction to be switched between a first position for guiding the sheet transported by the transport roller pair to the image forming apparatus, and a second position for guiding the sheet transported by the transport roller pair downward, and a storage tray disposed below the switch member predetermined space apart to be able to store the sheet guided to below the switch member positioned in the second position.

15 Claims, 9 Drawing Sheets

IMAGE FORMING SYSTEM

TECHNICAL FIELD

The present invention relates to an image forming system for forming images on sheets.

BACKGROUND ART

A generally known image forming system is provided with an image forming apparatus, and a sheet feed apparatus which is one example of a sheet transport apparatus and is arranged in parallel with the image forming apparatus. In order to be able to supply sheets to the image forming apparatus, the sheet feed apparatus includes feed cassettes for storing a plurality of sheets. In Japanese Unexamined Patent Publication No. 2007-279168, an image forming system is proposed to provide a retract tray above a sheet feed apparatus, and in the case of detecting an abnormality such as multi feed of sheets, discharge a plurality of stacked sheets to the retract tray.

DISCLOSURE OF INVENTION

Problems to be Solved by the Invention

However, in the image forming system described in Japanese Unexamined Patent Publication No. 2007-279168, since the retract tray is disposed above the sheet feed apparatus, a path for transporting the sheet to the retract tray is long, a drive mechanism such as a motor is further necessary to transport the sheet to the retract tray above, and there is a problem that the image forming system is increased in size.

It is an object of the present invention to miniaturize an image forming system.

Means for Solving the Problem

An image forming system of the present invention is provided with a sheet transport apparatus including a transport section capable of transporting a sheet in a predetermined sheet transport direction, and an image forming apparatus including an image forming section capable of forming an image on the sheet acquired from the sheet transport apparatus, where the sheet transport apparatus includes a switch member disposed on the downstream side of the transport section in the sheet transport direction to be switched between a first position for guiding the sheet transported by the transport section to the image forming apparatus, and a second position for guiding the sheet transported by the transport section downward, and a storage tray disposed below the switch member predetermined space apart to be able to store the sheet guided to below the switch member by the switch member positioned in the second position, and the image forming apparatus includes a side wall member that is a part of a member defining the predetermined space.

Advantageous Effect of the Invention

According to the present invention, it is possible to miniaturize the image forming system.

MODE FOR CARRYING OUT THE INVENTION

Figure 1:
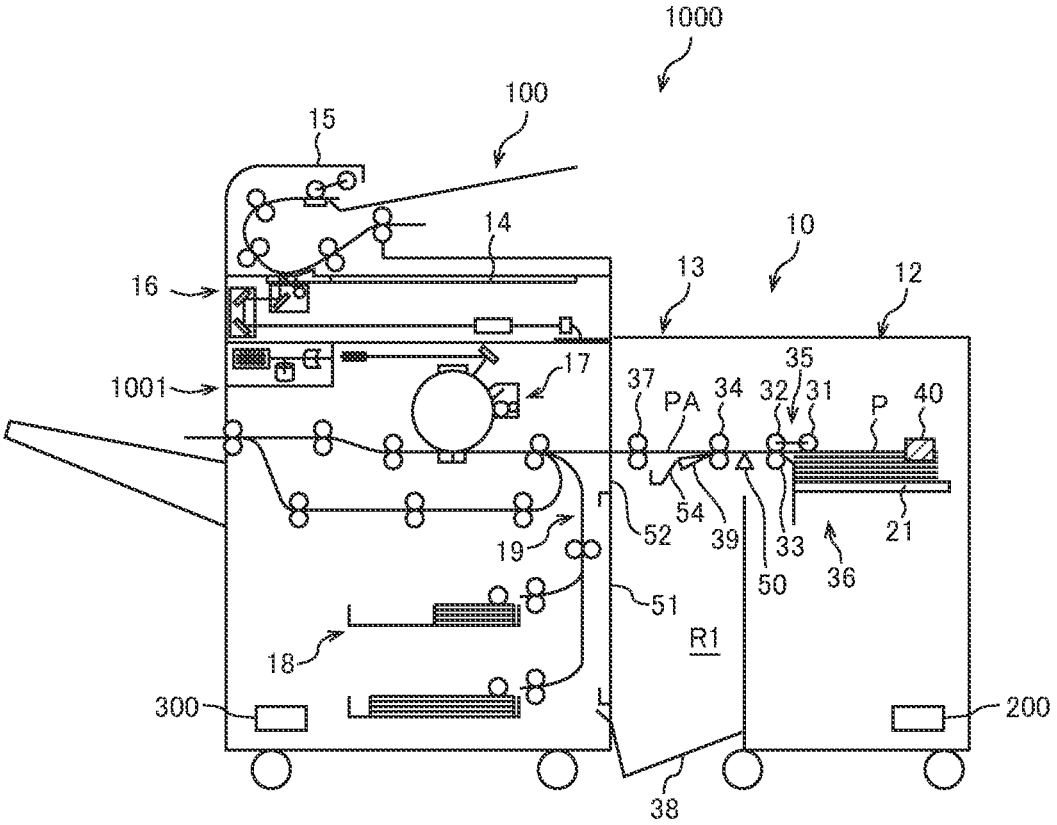
FIG. 1 is an explanatory view of an image forming system according to an Embodiment.

An Embodiment to carry out the present invention will be described below in detail with reference to drawings. FIG. 1 is an explanatory view of an image forming system 1000 according to the Embodiment. The image forming system 1000 shown in FIG. 1 is comprised of an image forming apparatus 100, and a sheet feed apparatus 10 that is one example of a sheet transport apparatus. The image forming apparatus 100 is a copier, printer, facsimile or complex thereof of an electrophotographic scheme. In addition, the image forming apparatus 100 is not limited to the electrophotographic scheme, and may be another scheme such as an inkjet scheme. As sheets, there are papers such as normal paper, thin paper and thick paper, plastic sheets and the like.

The image forming apparatus 100 is provided with an apparatus main body 1001, and a document reading section 16 including platen glass 14 and an ADF 15 disposed on the apparatus main body 1001. The apparatus main body 1001 is covered with an exterior cover (housing) 52. Further, the apparatus main body 1001 is provided with a sheet feed section 18 for feeding sheets, a main body transport section 19 for transporting fed sheets, an image forming section 17 for forming images on the sheets, and a control section 300 for controlling the sections disposed inside the exterior cover 52.

The control section 300 controls the image forming section 17 to form a toner image (image) on a sheet by the image forming section 17, corresponding to an image signal acquired from an outside apparatus such as a personal computer connected to be able to communicate, or an image signal acquired from the document reading section 16.

The sheet feed apparatus 10 is connected to the image forming apparatus 100, and feeds a sheet P to the image forming apparatus 100. The image forming section 17 of the image forming apparatus 100 acquires the sheet P fed to the sheet feed apparatus 10, and is capable of forming an image on the sheet P. In this Embodiment, the sheet feed apparatus 10 is provided with a sheet feed unit 12, a sheet storage unit 13 and a control section 200 for controlling each section of the sheet feed unit 12 and sheet storage unit 13.

The sheet storage unit 13 is disposed between the sheet feed unit 12 and the image forming apparatus 100. The sheet feed unit 12 is provided with a sheet feed section 36 for feeding the sheet P. The sheet feed section 36 includes a stack tray 21 capable of moving up and down in a state in which a plurality of sheets P is stacked, a delivery roller 31 coming into contact with the sheet P positioned uppermost in a bunch of sheets stacked on the stack tray 21, a separation feed section 35 including a feed roller 32 and separation roller 33 provided on the downstream side of the delivery roller 31 in a sheet transport direction. The sheet P is separated on a sheet-by-sheet basis to be fed by the separation feed section 35.

The sheet storage unit 13 is provided with a transport roller pair 34 capable of transporting the sheet P fed from the sheet feed section 36, as one example of a transport section. Further, the sheet storage unit 13 is provided with a downstream-side transport roller pair 37 capable of transporting the sheet P transported by the transport roller pair 34 to the image forming apparatus 100. Further, the sheet feed apparatus 10 is provided with a switch member 39 disposed on the downstream side of the transport roller pair 34 in the sheet transport direction and on the upstream side of the downstream-side transport roller pair 37 in the sheet transport direction, in a transport path PA of the sheet P. The switch member 39 is switched between a first position for guiding the sheet P transported to the transport roller pair 34 to the downstream-side transport roller pair 37 i.e. the image forming apparatus 100, and a second position for guiding the sheet P transported to the transport roller pair 34 in a downward direction different from a direction for guiding to the downstream-side transport roller pair 37 i.e. the image forming apparatus 100.

Concurrently with startup of the sheet feed apparatus 10, the stack tray 21 moves up to a feed position for enabling the delivery roller 31 to feed the uppermost sheet P among a bunch of sheets on the stack tray 21, and the delivery roller 31 starts feed of the sheet P. The sheet P fed from the stack tray 21 by the delivery roller 31 is nipped by the feed roller 32 and separation roller 33, while being separated on a sheet-by-sheet basis, is transported to the transport roller pair 34, and is transported to the image forming apparatus 100 by the transport roller pair 34 and downstream-side transport roller pair 37. Further, whenever the delivery roller 31 feeds the predetermined number of sheets, the stack tray 21 is controlled so that the uppermost sheet P is moved upward to the feed position.

In feed operation of the sheet P, the uppermost sheet P on the stack tray 21 is separated and fed on a sheet-by-sheet basis, and is continuously transported to the image forming apparatus 100 via the transport roller pair 34 and downstream-side transport roller pair 37. However, at this point, there is the case that multi feed occurs where a plurality of sheets p is overlapped and transported. It is considered that the case occurs by effects of reductions in separation performance of the separation feed section 35 due to wearing of the feed roller 32 and separation roller 33 and the like, changes in coefficient of friction between sheets caused by an environment such as a temperature, humidity or the like inside the sheet feed apparatus 10, adhesion of end portions of sheets by cutting burrs and the like.

When multi feed of sheets P occurs, the possibility of a paper jam i.e. jam is higher than transport of a single sheet. Further, even when image formation is finished with multi feed, a white sheet coexists in image-formed products, and for example, in the case of performing bookbinding and the like, the problem arises.

In this Embodiment, the sheet feed apparatus 10 is provided with an air blow mechanism 40 for blowing a certain quantity of air toward a side face of the uppermost sheet P on the stack tray 21, which is fed to the separation feed section 35 from the delivery roller 31. By the air blow mechanism 40, the friction between sheets is reduced, and it is thereby possible to reduce an adhesion state between sheets. However, even using the air blow mechanism 40, there is the case where multi feed of sheets P occurs.

In this Embodiment, the sheet feed apparatus 10 is provided with a multi feed detecting section 50 disposed on the upstream side of the transport roller pair 34 in the sheet transport direction to be able to detect multi feed that a plurality of sheets P is overlapped and fed from the sheet feed section 36.

Figure 2:
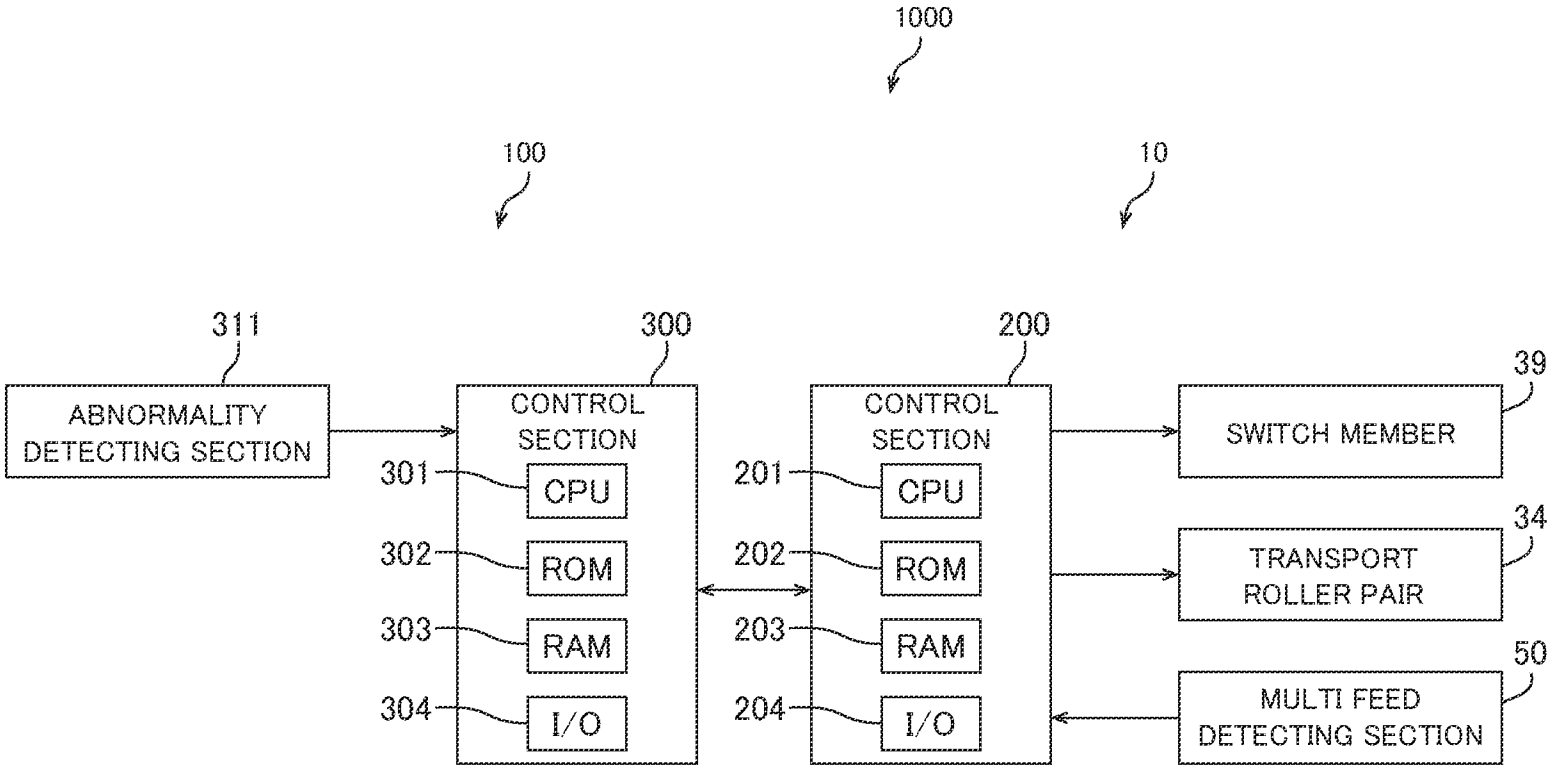
FIG. 2 is a block diagram illustrating a control system of the image forming system according to the Embodiment.

FIG. 2 is a block diagram illustrating a control system of the image forming system 1000 according to the Embodiment. A control section 300 of the image forming apparatus 100 includes a CPU 301, ROM 302, RAM 303 and I/O 304. While reading programs indicating control procedures stored in the ROM 302, the CPU 301 controls each section of the image forming apparatus 100, by referring to data such as operation data stored in the RAM 302 and input data input via the I/O 304.

The image forming apparatus 100 is provided with an abnormality detecting section 311 capable of detecting an abnormality. For example, the abnormality detecting section 311 is a sensor capable of detecting a jam of a sheet in the sheet transport path, and is comprised of a photo-interrupter disposed in the sheet transport path of the image forming apparatus 100. The CPU 301 determines whether a jam of a sheet occurs by determining whether or not the sheet passes through the photo-interrupter at predetermined timing.

A control section 200 of the sheet feed apparatus 10 includes a CPU 201, ROM 202, RAM 203 and I/O 204. While reading programs indicating control procedures stored in the ROM 202, the CPU 201 controls each section of the sheet feed apparatus 10, by referring to data such as operation data stored in the RAM 202 and input data input via the I/O 204. Targets for control by the CPU 201 in this Embodiment include the switch member 39 and transport roller pair 34. For example, the multi feed detecting section 50 is comprised of an ultrasonic sensor, photo-interrupter or the like. The multi feed detecting section 50 applies an ultrasonic wave or light to the sheet P in the transport path PA, and receives the ultrasonic wave or light passing through the sheet P in the transport path PA. The CPU 201 determines whether the sheet P is comprised of a single sheet or a plurality of sheets, from an attenuation amount of the ultrasonic wave or light passing through the sheet P in the transport path PA.

Figure 3:
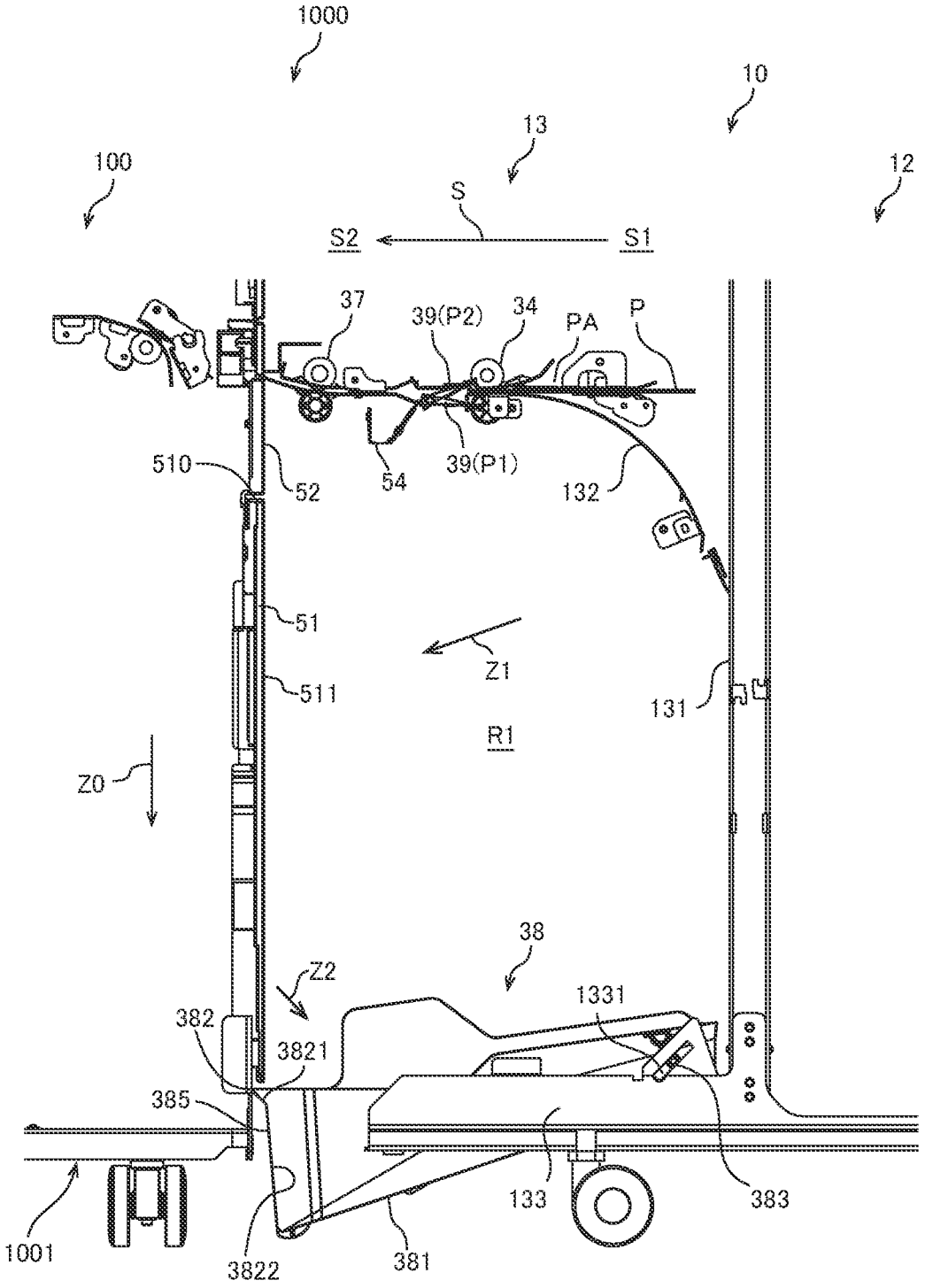
FIG. 3 is a cross-sectional schematic view of a principal part of the image forming system according to the Embodiment.

FIG. 3 is a cross-sectional schematic view of a principal part of the image forming system 1000 according to the Embodiment. The switch member 39 is capable of being switched between the first position P1 and the second position P2. The first position P1 is a position for guiding the sheet P transported to the transport roller pair 34 to the downstream-side transport roller pair 37 i.e. the image forming apparatus 100. The second position P2 is a position for guiding the sheet P transported to the transport roller pair 34 downward. In the second position P2, the switch member 39 guides the sheet P obliquely downward from the upstream side S1 in the sheet transport direction S toward the downstream side S2 in the sheet transport direction S i.e. in an arrow Z1 direction shown in FIG. 3. In the case where the multi feed detecting section 50 detects multi feed of the sheet P or in the case where the abnormality detecting section 311 detects an abnormality in the image forming apparatus 100, the switch member 39 is switched from the first position P1 to the second position P2 by the control section 200. In the case where the multi feed detecting section 50 does not detect multi feed of the sheet P or in the case where the abnormality detecting section 311 does not detect any abnormality, the switch member 39 is switched from the second position P2 to the first position P1 by the control section 200.

The sheet storage unit 13 has a storage tray 38 disposed below the switch member 39 predetermined space R1 apart. The storage tray 38 is capable of storing the sheet P guided by the switch member 39 positioned in the second position P2. By storing the multi-fed sheet P in the storage tray 38, without halting transport operation, it is possible to continue feed operation, while ensuring high productivity. Further, also in the case where the image forming apparatus 100 halts image forming operation due to an abnormality such as a jam of a sheet, it is possible to prevent a sheet from remaining in the transport path PA on the upstream side S1 from the switch member 39 in the sheet transport direction S.

The exterior cover 52 of the image forming apparatus 100 has a side wall member 51 that is a part of members defining the predetermined space R1. The predetermined space R1 is defined by members included in the sheet storage unit 13 and the side wall member 51 included in the exterior cover 52 of the image forming apparatus 100. For example, the members included in the sheet storage unit 13 to define the predetermined space R1 include a part of an exterior cover 131 of the sheet feed apparatus 10, a part of a member 132 forming the transport path PA, the storage tray 38 and the like.

The side wall member 51 includes a contact face 511 capable of being brought into contact with the sheet P guided by the switch member 39 positioned in the second position P2. The contact face 511 is a perpendicular face in this Embodiment. The sheet storage unit 13 has a guide member 54 disposed on the downstream side S2 from the switch member 39 in the sheet transport direction S. The guide member 54 guides the sheet P guided by the switch member 39 positioned in the second position P2 to the contact face 511.

The side wall member 51 that is a part of the exterior cover 52 of the image forming apparatus 100 is a member defining the predetermined space R1 below the switch member 39, and is capable of omitting to provide the sheet feed apparatus 10 with a side wall member. In the sheet feed apparatus 10, it is possible to omit the side wall member to define the predetermined space R1, and it is thereby possible to miniaturize the image forming system 1000. Further, while miniaturizing the image forming system 1000, it is possible to make the predetermined space R1 wide, and it is possible to store many sheets in the storage tray 38. Furthermore, inside the sheet feed apparatus 10, it is not necessary to provide an escape path dedicated to guiding of the sheet to the storage tray 38, and it is possible to save space and reduce cost of the image forming system 1000.

Figure 4:
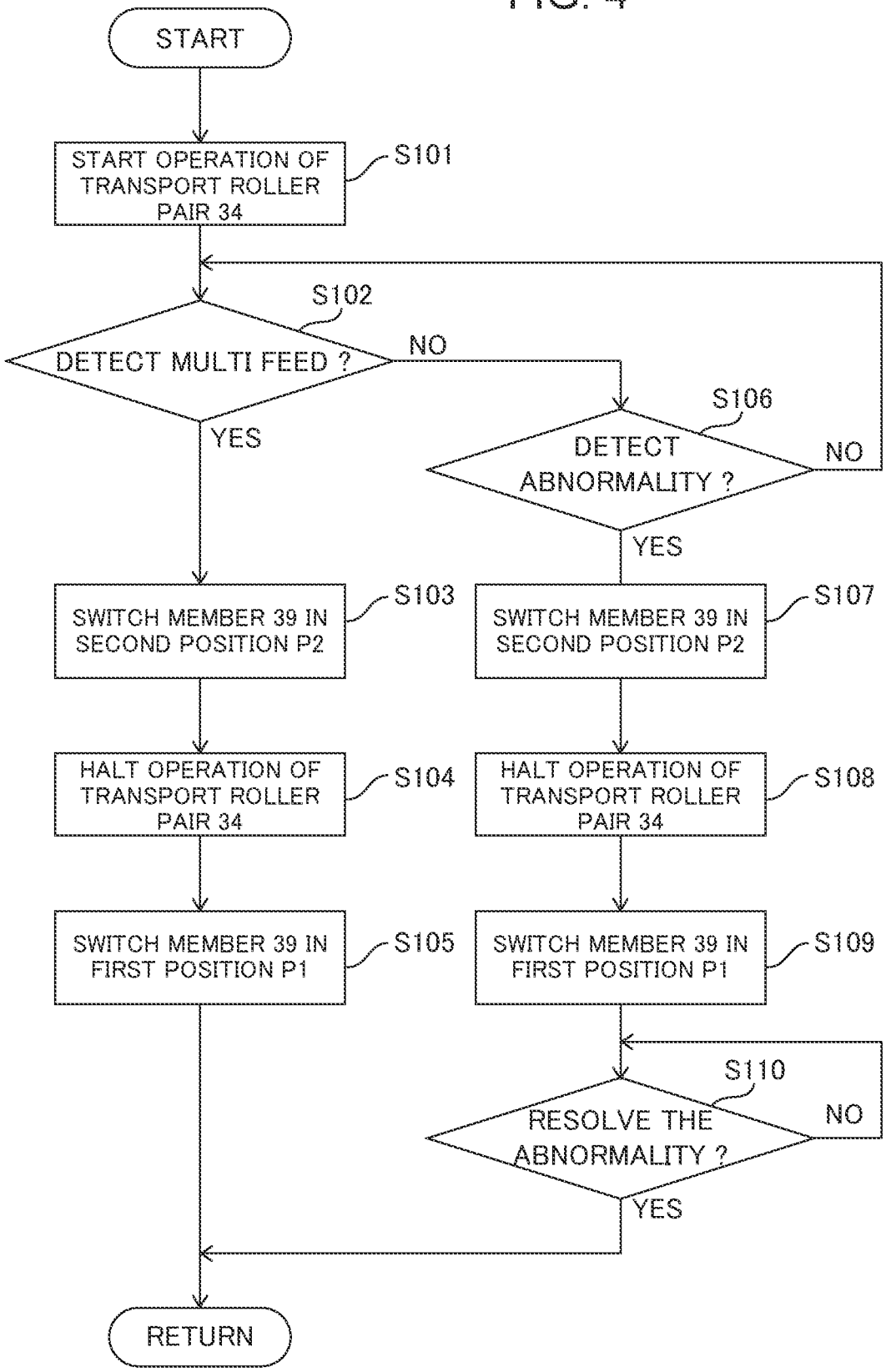
FIG. 4 is a flowchart of operation of a sheet feed apparatus according to the Embodiment.
Figure 5:
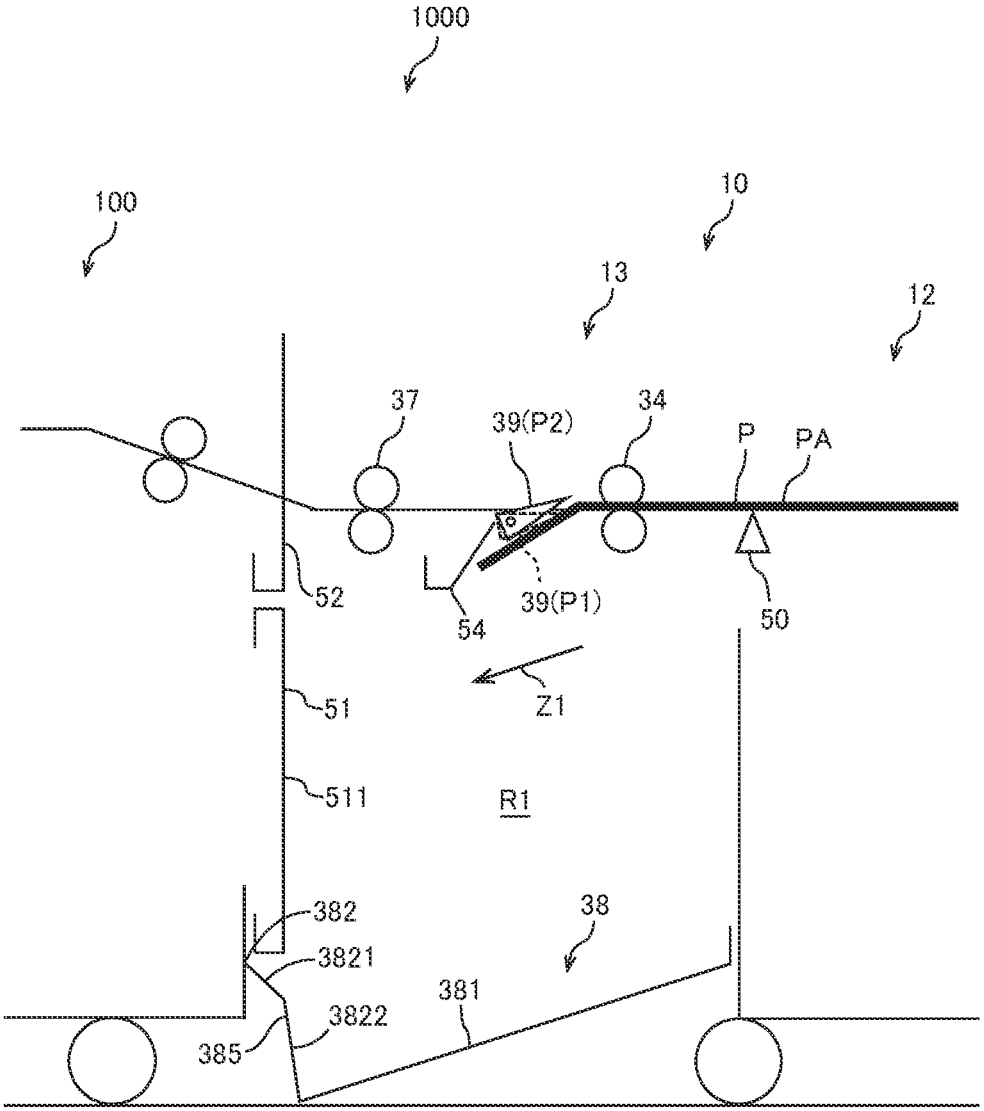
FIG. 5 is a schematic view to explain operation of the sheet feed apparatus according to the Embodiment.
Figure 6:
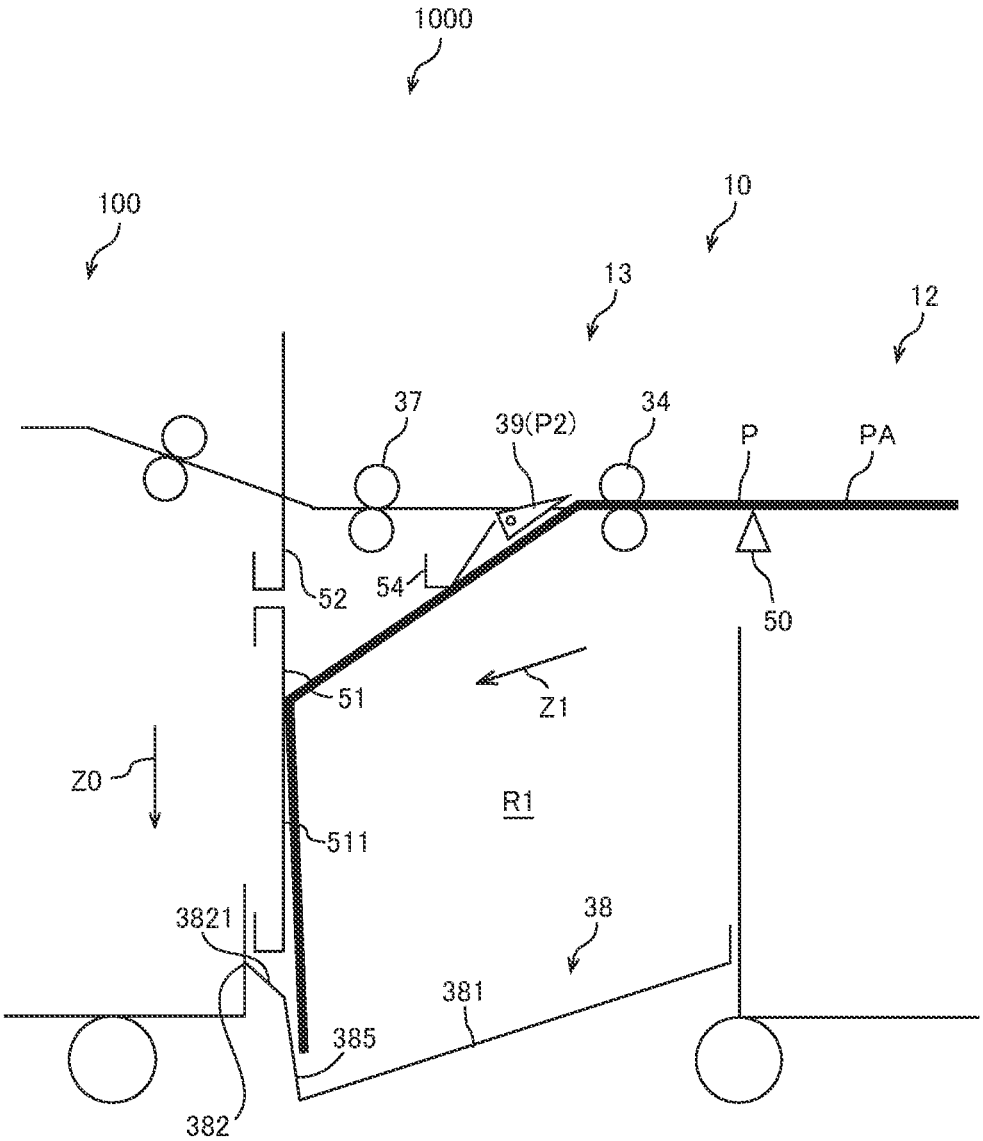
FIG. 6 is another schematic view to explain operation of the sheet feed apparatus according to the Embodiment.

FIG. 4 is a flowchart of operation of the sheet feed apparatus 10 according to the Embodiment. FIGS. 5 and 6 are schematic views to explain operation of the sheet feed apparatus 10 according to the Embodiment. Described below is control of the transport roller pair 34 and switch member 39 in an image forming job of the image forming system 1000. In the case of receiving a feed instruction from the control section 300 of the image forming apparatus 100, the CPU 201 of the control section 200 starts operation of the transport roller pair 34 (S101). The switch member 39 is positioned in the first position P1. During operation of the transport roller pair 34, based on detection results of the multi feed detecting section 50, the CPU 201 determines whether the sheet fed from the sheet feed section 36 is multi-fed (S102).

In the case where the sheet fed from the sheet feed section 36 is multi-fed (S102: YES), as shown in FIG. 5, the CPU 201 switches the switch member 39 from the first position P1 shown by dashed lines to the second position P2 shown by solid lines (S103). In other words, in the case where the multi feed detecting section 50 detects multi feed of the sheet, by control by the CPU 201, the switch member 39 is switched from the first position P1 to the second position P2. By this means, the multi-fed sheet does not travel to the image forming apparatus 100, and is transported in an arrow Z1 direction that is obliquely downward. A switch amount i.e. a switch angle of the switch member 39 from the first position P1 to the second position P2 may be beforehand set corresponding to weighing and/or size of transported sheets.

As shown in FIG. 6, the sheet P transported by the transport roller pair 34 comes into contact with the contact face 511 of the side wall member 51 of the image forming apparatus 100, is guided downward in a vertical direction Z0 along the contact face 511, and is stacked on the storage tray 38. Further, after the multi-fed sheet P is stacked on the storage tray 38, the CPU 201 halts operation of the transport roller pair 34 (S104), and switches the switch member 39 from the second position P2 to the first position P1 (S105). After shifting the switch member 39 to the first position P1, the CPU 201 returns to S101 and continues normal feed operation.

Thus, during feed operation of sheets in the sheet feed apparatus 10, by storing the multi-fed sheet P in the storage tray 38, it is possible to continue feed operation for the next sheet, and without halting the feed operation, it is possible to ensure high productivity.

In the case where the sheet fed from the sheet feed section 36 does not cause multi feed (S102: NO), the CPU 201 determines whether an abnormality of the image forming apparatus 100 is detected (S106).

In the case of detecting the abnormality of the image forming apparatus 100 (S106: YES), as shown in FIG. 5, the CPU 201 switches the switch member 39 from the first position P1 to the second position P2 (S107). In other words, in the case where the abnormality detecting section 311 detects the abnormality, by control by the CPU 201, the switch member 39 is switched from the first position P1 to the second position P2. By this means, the sheet P fed to the sheet feed section 36 does not travel to the image forming apparatus 100 by the guide of the switch member 39, and is transported in the arrow Z1 direction that is obliquely downward by the transport roller pair 34.

As shown in FIG. 6, the sheet P transported to the transport roller pair 34 comes into contact with the contact face 511 of the side wall member 51 of the image forming apparatus 100, is guided downward in the vertical direction Z0 along the contact face 511, and is stacked on the storage tray 38. Further, after the sheet P is stacked on the storage tray 38, the CPU 201 halts operation of the transport roller pair 34 (S108), and switches the switch member 39 from the second position P2 to the first position P1 (S109). The CPU 201 determines whether the abnormality is resolved (S110), and when the abnormality is not resolved (S110: NO), waits without performing any operation. When the abnormality is resolved (S110: YES), the CPU 201 resumes operation of the transport roller pair 34.

In step S110, with respect to whether the abnormality is resolved, it is determined whether a sheet remains in the transport path of the image forming apparatus 100. When a sheet remains in the transport path, since the abnormality is not resolved, image forming operation is halted. In this Embodiment, for even a sheet which is fed by the sheet feed section 36 and is under transport, when a front end portion of the sheet in the sheet transport direction S is positioned on the upstream side from the switch member 39 in the sheet transport direction, as the multi-fed sheet, the sheet is capable of being stored in the storage tray 38. In the sheet feed apparatus 10, since the sheet in the transport path PA is sent to the storage tray 38, the sheet is prevented from remaining in the transport path PA, and when an abnormality such as a jam of a sheet occurs in the image forming apparatus 100, it is possible to reduce operation for an operator to remove the sheet from the sheet feed apparatus 10 of the image forming system 1000.

In the case where multi feed is not detected in the sheet feed section 36 and any abnormality is not detected also in the image forming apparatus 100 (S106: NO), the CPU 201 continues operation of the transport roller pair 34. Since the switch member 39 is positioned in the first position P1, a sheet fed from the sheet feed section 36 is transported to the image forming apparatus 100 by the transport roller pair 34.

Figure 7:
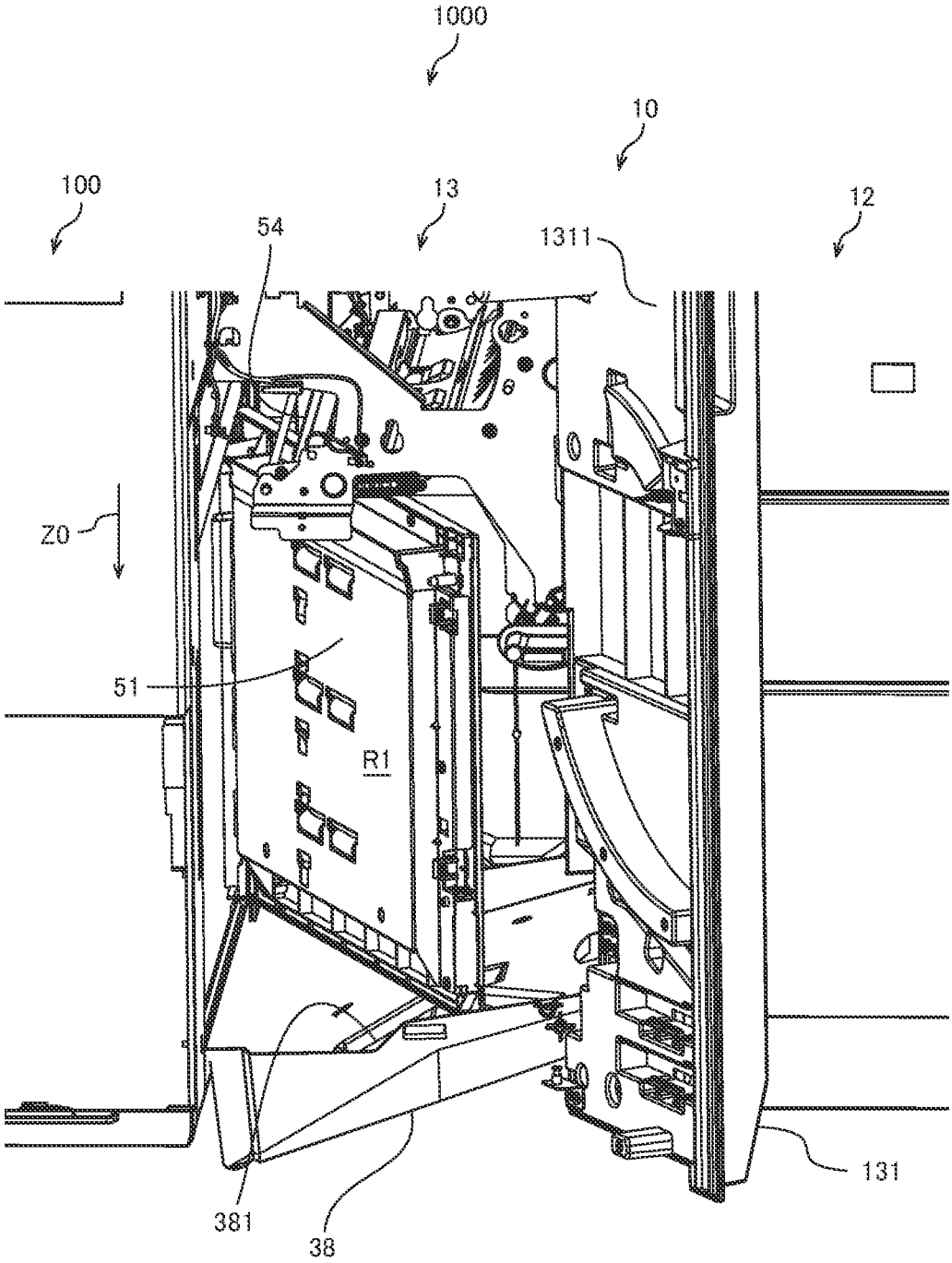
FIG. 7 is a perspective view of a part of the image forming system when a side wall member is in an open state in the Embodiment.

In addition, in the case where a jam of a sheet occurs inside the apparatus main body 1001 of the image forming apparatus 100, it is necessary that the operator performs processing for removing the jammed sheet. Hereinafter, the processing is referred to as jam processing. The side wall member 51 is provided in the apparatus main body 1001 to be openable and closable, in order to enable the operator to have access into the apparatus main body 1001 to perform the jam processing, in the case where a jam of a sheet occurs inside the apparatus main body 1001 of the image forming apparatus 100. In other words, the side wall member 51 is a door member provided in the apparatus main body 1001 to be openable and closable. The side wall member 51 is capable of shifting between an open position and a close position. FIGS. 1, 3, 5 and 6 illustrate the case where the side wall member 51 is in a close state. FIG. 7 is a perspective view of a part of the image forming system 1000 in the case where the side wall member 51 is in an open state in the Embodiment.

The side wall member 51 that is the door member of the image forming apparatus 100 is capable of being opened toward the side of the predetermined space R1. Accordingly, without separating the sheet feed apparatus 10 from the image forming apparatus 100, it is possible to have access into the image forming apparatus 100 to perform the jam processing.

In order not to interfere with the guide member 54 in the open state, the side wall member 51 is positioned below the guide member 54 in the vertical direction Z0 in the open state. Further, in order not to interfere with the storage tray 38 in the open state, the side wall member 51 is positioned above a bottom portion 381 of the storage tray 38 in the vertical direction Z0 in the open state. The close position of the side wall member 51 is a regulation position for regulating access of the operator to the image forming apparatus 100, in the case where the image forming apparatus 100 performs image forming operation. The open position of the side wall member 51 is a jam processing position for allowing the operator to have access to the image forming apparatus 100, when a jam of a sheet occurs inside the image forming apparatus 100. Thus, in opening the side wall member 51, the side wall member 51 is prevented from interfering with the guide member 54 and storage tray 38, and it is possible to easily perform the jam processing on the sheet inside the image forming apparatus 100.

Further, the sheet feed apparatus 10 has a door member 1311 which is a part of the exterior cover 131, is openable and closable with respect to the sheet feed apparatus main body, and enables the predetermined space R1 to be opened. FIG. 7 illustrates the case where the door member 1311 is in an open state. By opening the door member 1311, the operator is capable of having access to the storage tray 38, and further, of operating to open and close the side wall member 51 that is the door member of the image forming apparatus 100.

Figure 8:
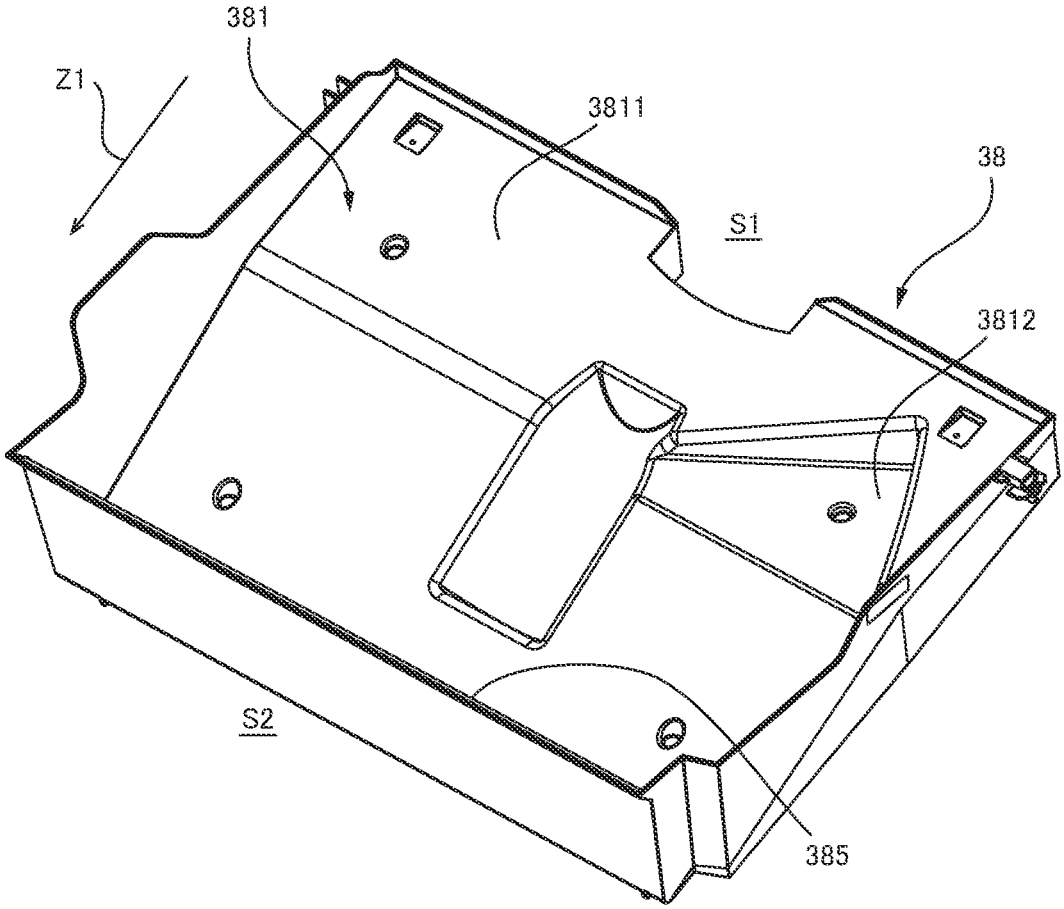
FIG. 8 is a perspective view of a storage tray according to the Embodiment.

FIG. 8 is a perspective view of the storage tray 38 according to the Embodiment. The bottom portion 381 of the storage tray 38 has a bottom face 3811 inclined obliquely downward from the upstream side S1 in the sheet transport direction S toward the downstream side S2 in the sheet transport direction S i.e. inclined in the arrow Z1 direction, and a concave portion 3812 dented with respect to the bottom face 3811 so as not to interfere with the side wall member 51 of the open state.

As shown in FIG. 8, since the bottom face 3811 is inclined, the sheet falling to the storage tray 38 slides obliquely downward along the inclined bottom face 3811, and is stacked on the bottom face 3811 in a state in which the sheet end portion is brought into contact with a side wall portion 385 of the storage tray 38 on the downstream side S2 in the sheet transport direction S. By this means, stacking characteristics of sheets are improved in the storage tray 38, and further, it is easy for an operator to remove the sheet from the storage tray 38.

An end portion on the downstream side S2 in the sheet transport direction S in the bottom face 3811 is the deepest part in the storage tray 38. An inclined angle of the bottom face 3811 with respect to the horizontal surface (floor surface) in the storage tray 38 is capable of being adjusted using a position for fixing the storage tray 38 to a frame 133 of the sheet feed apparatus 10 shown in FIG. 3. Specifically, a slit 1331 is formed in the frame 133, and by a screw 383 screwed to the storage tray 38 via the slit 1331, the storage tray 38 is fixed to the frame 133. Using the position of the screw 383 with respect to the slit 1331, it is possible to determine a position and inclined angle of storage tray 38 with respect to the frame 133. In addition, it is preferable to position the storage tray 38 with respect to the frame 133 so that the end portion on the downstream side S2 in the sheet transport direction S in the bottom face 3811 of the storage tray 38 i.e. the lowest end portion of the storage tray 38 comes into contact with the floor surface. Further, it is preferable to position the storage tray 38 with respect to the frame 133 so that an end portion 382 on the downstream side S2 in the sheet transport direction S in the storage tray 38 comes into contact with the apparatus main body 1001 of the image forming apparatus 100.

As shown in FIG. 3, the end portion 382 on the downstream side S2 in the sheet transport direction Sin the storage tray 38 is positioned below the contact face 511 of the side wall member 51 of the close state. By the end portion 382 of the storage tray 38 positioning below the contact face 511 of the side wall member 51, it is possible to prevent the front end portion of the sheet P guided downward in the vertical direction Z0 along the contact face 511 from being caught in the end portion 382 of the storage tray 38, and thereby prevent a jam such as a sheet jam from occurring. Further, the end portion 382 of the storage tray 38 is positioned on the downstream side S2 in the sheet transport direction S with respect to the contact face 511 of the side wall member 51. In other words, the end portion 382 of the storage tray 38 is disposed, while overlapping with the contact face 511 of the side wall member 51 on the downstream side S2 in the sheet transport direction S. As described previously, in the storage tray 38, by the position of the screw 383 with respect to the slit 1331, it is possible to adjust the position and inclined angle with respect to the frame 133. Accordingly, there is a possibility that a gap occurs between the side wall member 51 and the end portion 382 of the storage tray 38. When the gap exists between the side wall member 51 and the storage tray 38, there is the case where the sheet P falling along the contact face 511 of the side wall member 51 runs outside the apparatus from the gap. In contrast thereto, the end portion 382 of the storage tray 38 in this Embodiment is disposed, while overlapping with the contact face 511 of the side wall member 51 on the downstream side in the sheet transport direction, and therefore, the sheet P falling along the contact face 511 is capable of being reliably guided to the storage tray 38.

The end portion 382 is an upper end portion of the side wall portion 385. The side wall portion 385 of the storage tray 38 has an inclined face 3821 inclined obliquely downward toward the upstream side S1 in the sheet transport direction S from the end portion 382 i.e. inclined in an arrow Z2 direction, and a side wall face 3822 continued to the inclined face 3821 toward the upstream side S1 in the sheet transport direction S. Further, an inclined angle of the inclined face 3821 with respect to a virtual perpendicular surface is larger than an inclined angle of the side wall face 3822 with respect to the virtual perpendicular surface. It is preferable that the inclined face 3821 is positioned below the contact face 511 in the vertical direction Z0. By this means, the sheet P falling along the contact face 511 is guided to the bottom face 381 of the storage tray 38 by the inclined face 3821 of the storage tray 38. Therefore, it is possible to effectively prevent the sheet P falling along the contact face 511 from being caught in the end portion 382 of the storage tray 38. In other words, by the inclined face 3821, it is possible to provide the sheet P falling toward the storage tray 38 with occurrence of a force for shifting toward the upstream side S1 in the sheet transport direction S. By this means, it is possible to separate the sheet P falling toward the storage tray 38 from the side wall member 51, and stacking characteristics of the sheet P are improved in the storage tray 38.

Figure 9:
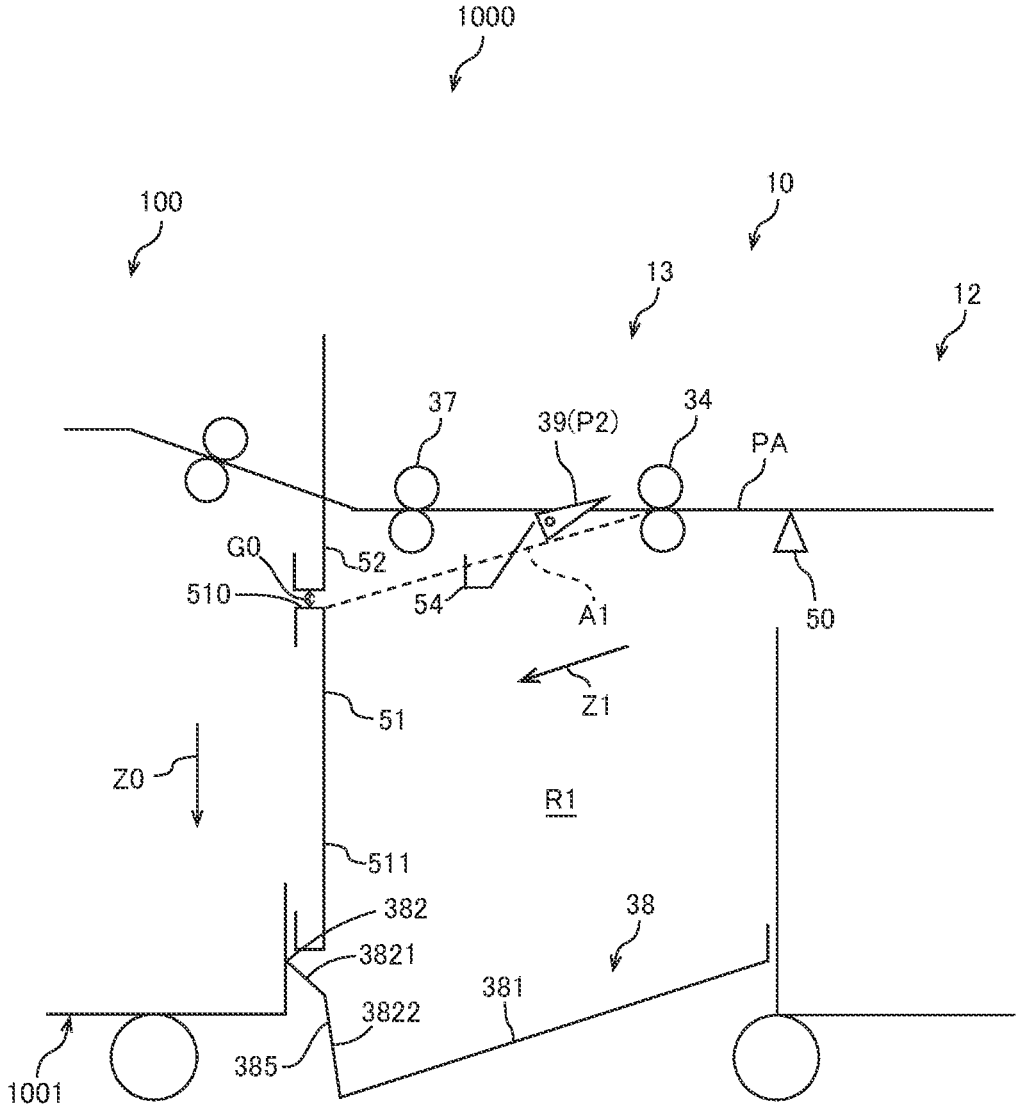
FIG. 9 is a schematic view of the sheet feed apparatus according to the Embodiment.

FIG. 9 is a schematic view of the sheet feed apparatus 10 according to the Embodiment. As described previously, since the side wall member 51 is the door member provided in the apparatus main body 1001 to be openable and closable, a gap G0 occurs between the apparatus main body 1001 of the image forming apparatus 100 and an upper end portion 510, in the vertical direction Z0, of the side wall member 51 positioned in the close position. The guide member 54 guides the sheet, which is transported by the transport roller pair 34 and is guided obliquely downward by the switch member 39, to the contact face 511 so as to bring the sheet into contact with the contact face 511 of the side wall member 51. Specifically, the guide member 54 is disposed in a position overlapping a virtual straight line (virtual plane) A1 shown by dashed lines connecting between a nip position of the transport roller pair 34 and the upper end portion 510 of the side wall member 51 in the vertical direction Z0. By this means, it is possible to prevent the front end portion of the sheet from being caught in the gap G0 between the apparatus main body 1001 and the upper end portion 510 of the side wall member 51, and thereby prevent the sheet from being jammed.

In addition, the present invention is not limited to the Embodiment as described above, and allows many modifications to be made within the technical idea of the invention. Further, with respect to effects described in the Embodiment, most suitable effects occurring from the invention are only enumerated, and effects by the invention are not limited to the effects described in the Embodiment.

In addition, this application claims priority from Japanese Patent Application No. 2019-239875, Japanese Patent Application No. 2019-239876, and Japanese Patent Application No. 2020-099629 incorporated herein by reference.

The invention claimed is:

1. An image forming system comprising:

a sheet transport apparatus including a transport section capable of transporting a sheet in a predetermined sheet transport direction; and an image forming apparatus including an image forming section capable of forming an image on the sheet acquired from the sheet transport apparatus, wherein the sheet transport apparatus includes a switch member disposed on a downstream side of the transport section in the sheet transport direction to be switched between a first position for guiding the sheet transported by the transport section to the image forming apparatus, and a second position for guiding the sheet transported by the transport section downward, and a storage tray disposed below the switch member predetermined space apart to be able to store the sheet guided to below the switch member by the switch member positioned in the second position, and the image forming apparatus includes a side wall member that is a part of a member defining the predetermined space.

2. The image forming system according to claim 1, wherein the switch member guides the sheet obliquely downward from an upstream side in the sheet transport direction toward the downstream side in the sheet transport direction, in the second position, and the side wall member includes a contact face capable of being brought into contact with the sheet guided by the switch member positioned in the second position.

3. The image forming system according to claim 2, wherein the sheet transport apparatus includes a guide member for guiding the sheet guided by the switch member positioned in the second position to the contact face.

4. The image forming system according to claim 3, wherein an end portion on the downstream side in the sheet transport direction in the storage tray is positioned below the contact face of the side wall member, on the downstream side in the sheet transport direction.

5. The image forming system according to claim 4, wherein the storage tray includes an inclined face inclined obliquely downward from the end portion toward the upstream side in the sheet transport direction.

6. The image forming system according to claim 3, wherein the side wall member is a door member provided in an apparatus main body of the image forming apparatus to be openable and closable, and the door member is positioned below the guide member, while being positioned above a bottom portion of the storage tray, in an open state.

7. The image forming system according to claim 6, wherein the bottom portion of the storage tray includes a bottom face inclined obliquely downward from the upstream side in the sheet transport direction toward the downstream side in the sheet transport direction.

8. The image forming system according to claim 7, wherein the bottom portion of the storage tray includes a concave portion dented with respect to the bottom face so as not to interfere with the door member.

9. The image forming system according to claim 2, wherein an end portion on the downstream side in the sheet transport direction in the storage tray is positioned below the contact face of the side wall member, on the downstream side in the sheet transport direction.

10. The image forming system according to claim 9, wherein the storage tray includes an inclined face inclined obliquely downward from the end portion toward the upstream side in the sheet transport direction.

11. The image forming system according to claim 1, wherein the sheet transport apparatus includes a multi feed detecting section capable of detecting multi feed of sheets transported by the transport section, and when the multi feed detecting section detects the multi feed of sheets, the switch member is switched from the first position to the second position.

12. The image forming system according to claim 1, wherein the image forming apparatus includes an abnormality detecting section capable of detecting an abnormality, and when the abnormality detecting section detects the abnormality, the switch member is switched from the first position to the second position.

13. The image forming system according to claim 1, wherein the side wall member is a door member provided in an apparatus main body of the image forming apparatus to be openable and closable, and the door member is positioned above a bottom portion of the storage tray, in an open state.

14. The image forming system according to claim 13, wherein the bottom portion of the storage tray includes a bottom face inclined obliquely downward from the upstream side in the sheet transport direction toward the downstream side in the sheet transport direction.

15. The image forming system according to claim 14, wherein the bottom portion of the storage tray includes a concave portion dented with respect to the bottom face so as not to interfere with the door member.

* * * * *